US005692264A

United States Patent [19]

van der Steur

[11] Patent Number: 5,692,264

[45] Date of Patent: *Dec. 2, 1997

[54] DOOR STOP

[76] Inventor: Gunnar van der Steur, 3415 McCommons Rd., Churchville, Md. 21078

[ * ] Notice: The portion of the term of this patent subsequent to Apr. 17, 2013, has been disclaimed.

[21] Appl. No.: 632,803

[22] Filed: Apr. 17, 1996

[51] Int. Cl.[6] ..... E05F 5/02

[52] U.S. Cl. ..... 16/82; 16/374; 16/86 R

[58] Field of Search ..... 16/82, 83, 371, 16/374, 377, 86 R, 86 A, 86 B

[56] References Cited

U.S. PATENT DOCUMENTS

| | | | |
|---|---|---|---|
| 1,445,681 | 2/1923 | Hage | 16/86 A |
| 1,884,827 | 10/1932 | Perry | 16/86 R |
| 1,884,828 | 10/1932 | Perry | 16/86 R |
| 1,884,832 | 10/1932 | Perry | 16/86 R |
| 1,991,517 | 2/1935 | Perry | 16/86 R |
| 3,758,141 | 9/1973 | Weiberger | 16/82 |
| 5,027,471 | 7/1991 | Barnes | 16/82 |

*Primary Examiner*—Chuck Y. Mah
*Attorney, Agent, or Firm*—Foley & Lardner

[57] ABSTRACT

A stop particularly adapted to keep a pivoting member of an automobile, such as a door, ajar so that it is out of contact with the automobile frame during painting, is made of a unitary piece of a thermoplastic material, such as polyphenylene sulfide. The stop can be formed through an injection molding. The stop has a generally elongated body with at least one brace portion adapted to engage a post section of the frame. The stop further has at least one hem flange slot extending generally in the direction of the elongated body, which slot is adapted to receive a hem flange section of the frame. At least one locator extends laterally from the elongated body and is adapted for insertion to a locator opening adjacent the post section. At least one abutting portion extends laterally from the elongated body and is adapted to abut against a portion of the pivoting member to keep the pivoting member from engaging the hem flange.

24 Claims, 6 Drawing Sheets

DOOR STOP

BACKGROUND OF THE INVENTION

When painting articles that have movable parts, such as a door, hood or gas cap of an automobile chassis, the movable part must be controlled during the painting process. For example, in an automated painting assembly line used in a modern automobile manufacturing facility, the door must be controlled so that the inside portions of the door and the door frame receive appropriate coatings of paint and other coating materials applied to the automobile chassis for protective purposes.

Door stops have been employed to facilitate the control of an automobile door during the painting process. Conventionally, a metal door stop consisting of a tubular metal handle section and a blade section positioned at an end of the tubular handle section is installed in the vehicle such that the blade section engages with an interior portion of the vehicle or with a channel in the vehicle chassis and the tubular handle section sits between the door and the door frame to prevent the door from closing fully during the painting process. By preventing the door from closing, the door stop prevents the interior of the door from contacting the door frame and adversely affecting the quality of the paint job on either the door frame or the door.

Conventional metal door stops used in the above-described manner present many problems. For example, the metal door stop is positioned by a human operator in the beginning of the painting process and is removed by a human operator at the end of the painting process. The quality of the paint job can be affected by a human operator misplacing the metal door stop. This is because the part of the chassis in contact with the metal door stop will not receiving a coating. Thus, if the human operator places the metal door stop in the wrong location, the quality of the paint job will be affected.

Further, it is conventional for a human operator to place the metal door stop along the bottom of the door frame within the automobile chassis so that gravitational forces will help to keep the metal door stop in place. However, in an automated factory, this type of door stop presents problems, in that it does not always stay in place, for example, when the automobile chassis moves up an incline or down a decline of the conveyor system. This placement of the door stop also has a negative impact since it invariably leads to a portion of the lower door frame, the portion proximate to the metal door stop, being uncoated or receiving a less than complete coating during the painting process.

Another drawback of the conventional painting process is that the metal door stops become fully coated with paint during the painting process and, after being recycled through the painting process a certain number of times, begin to chip or flake in such a way that the chips or flakes falling therefrom can adversely affect the paint job of an automobile. Thus, the metal door stops must be cleaned periodically, by, for example, a process such as sandblasting, which removes all of the paint therefrom. The sandblasting process is fairly expensive, but is necessary in order to insure high quality paint jobs by minimizing the likelihood of a chipping or flaking door stop. Sandblasting, or some similarly harsh process must be used to clean the layers of paint from a metal door stop because the paint being applied to the automobiles adheres very well to the metal surface of the metal door stop.

The sandblasting process also can result in problems if not performed well. For example, if the paint is not completely removed, paint debris can result in dust being entered into the painting process, thereby leading to costly repair procedures.

An additional drawback of metal door stops is that they are fairly expensive to manufacture, dictating that they be cleaned and reused repeatedly. Further, metal doorstops are fairly heavy, such that their positioning in the automobile chassis may require potentially strenuous lifting.

SUMMARY OF THE INVENTION

It is an object of the invention to overcome the aforementioned drawbacks by providing a door stop that is made from a plastic material, is inexpensive, is lightweight, is easy to clean, can be easily installed on a vehicle frame in a manner that minimizes the portion of the vehicle frame is not coated and reduces door flex and overslam.

It is another object of the invention to provide a multi-functional door stop in that it has a plurality of sections, each specifically designed for use with a given door, such as a front door, a rear door, a trunk, a hood or a gas cap cover of an automobile. In this way, the aforementioned advantages can be achieved while minimizing the variety of individual door stop types necessary for painting a given automobile.

One embodiment of a door stop according to the invention includes means for securing the stop to a portion of an automobile body and means for causing a pivoting member of the automobile to be out of contact with the automobile body during a painting operation, wherein the means for securing and means for causing are made of a plastic material. The plastic material may comprise, for example, polyphenylene sulfide. The door stop according to this first embodiment can be made, for example, by injection molding, such as high temperature engineered thermoplastic injection molding.

A door stop according to a second embodiment of the invention includes a body, a protruding member contiguous with the body and forming a hem flange groove with the body, a brace contiguous with the body and forming a post slot with the body and a locator proximate to the brace.

Another hem flange door stop according to the invention includes the aforementioned body, protruding member, brace and locator, and further includes a hem slot undercut proximate to the hem flange groove.

According to the invention, the body, protruding member, brace and locator of the aforementioned hem flange door stop can be made from a plastic, such as polyphenylene sulfide, and can be manufactured, for example, through thermoplastic injection molding.

In another example according to the invention, a hem flange door stop including the body, protruding member, brace and locator, can further include stabilizer bar attaching hole formed in the body.. A hem flange door securing system according to the invention can include such a hem flange door stop and can further include a stabilizer bar.

Another example of a hem flange door stop according to the invention includes means for affixedly positioning the hem flange door stop in a hem flange of an automobile chassis, means for engaging with a post hole of the automobile chassis and means for preventing a door from moving beyond a predetermined position relative to the hem flange. Such a hem flange door stop can further include means for controlling the position of the door relative to the hem flange. The means for controlling can be, for example, a stabilizer bar.

In another embodiment according to the invention, a hem flange door stop includes a body, a first protruding member contiguous with the body and forming a first hem flange groove with the body, a first brace contiguous with the body and forming a first post slot with the body, a first locator proximate to the first brace, a second protruding member contiguous with the body and forming a second hem flange groove with the body, a second brace contiguous with the body and forming a second post slot with the body, and a second locator proximate to the second brace. The first protruding member, first brace and first locator of this embodiment can be configured for positioning the hem flange door stop to stop a first door, while the second protruding member, second brace and second locator can be configured for positioning the hem flange door stop to stop a second door. The hem flange door stop according to this embodiment can further include a first hem slot undercut proximate to the first hem flange groove, and can further include a second hem slot undercut proximate to the second hem flange groove. The body, first protruding member, first brace, second brace, first locator and second locator can be made from plastic, such as, for example, polyphenylene sulfide, and the hem flange door stop can be manufactured through thermoplastic injection molding.

Another embodiment according to the invention provides a method of painting an automobile including the steps of inserting a plastic door stop in a hem flange, painting a door of the automobile and a body of the automobile proximate to the plastic door stop, and removing the plastic door stop from the hem flange.

Another embodiment according to the invention provides a method of painting an automobile, which includes the steps of inserting a door stop into a hem flange, painting a door of the automobile and a body of the automobile proximate to the door stop, and removing the door stop from the hem flange, wherein the step of inserting the door stop in the hem flange includes the steps of positioning the hem flange into a hem flange groove of the door stop, and positioning a locator of the door stop into a post hole of the automobile.

Another embodiment according to the invention provides a method of painting an automobile, which includes the steps of inserting a door stop into a hem flange, painting a door of the automobile and a body of the automobile proximate to the door stop, and removing the door stop from the hem flange, wherein the step of inserting the door stop in the hem flange includes the steps of positioning the hem flange into a hem flange groove of the door stop, and positioning a locator of the door stop into a post hole of the automobile body, wherein the step of positioning the hem flange into the hem flange groove of the door stop includes temporarily positioning a portion of the hem flange into a hem slot undercut of the door stop.

BRIEF DESCRIPTION OF THE DRAWINGS

These and other objects and advantages of the invention will be apparent from a review of the drawings wherein.

DETAILED DESCRIPTION OF THE PREFERRED EMBODIMENTS

Figure 1:
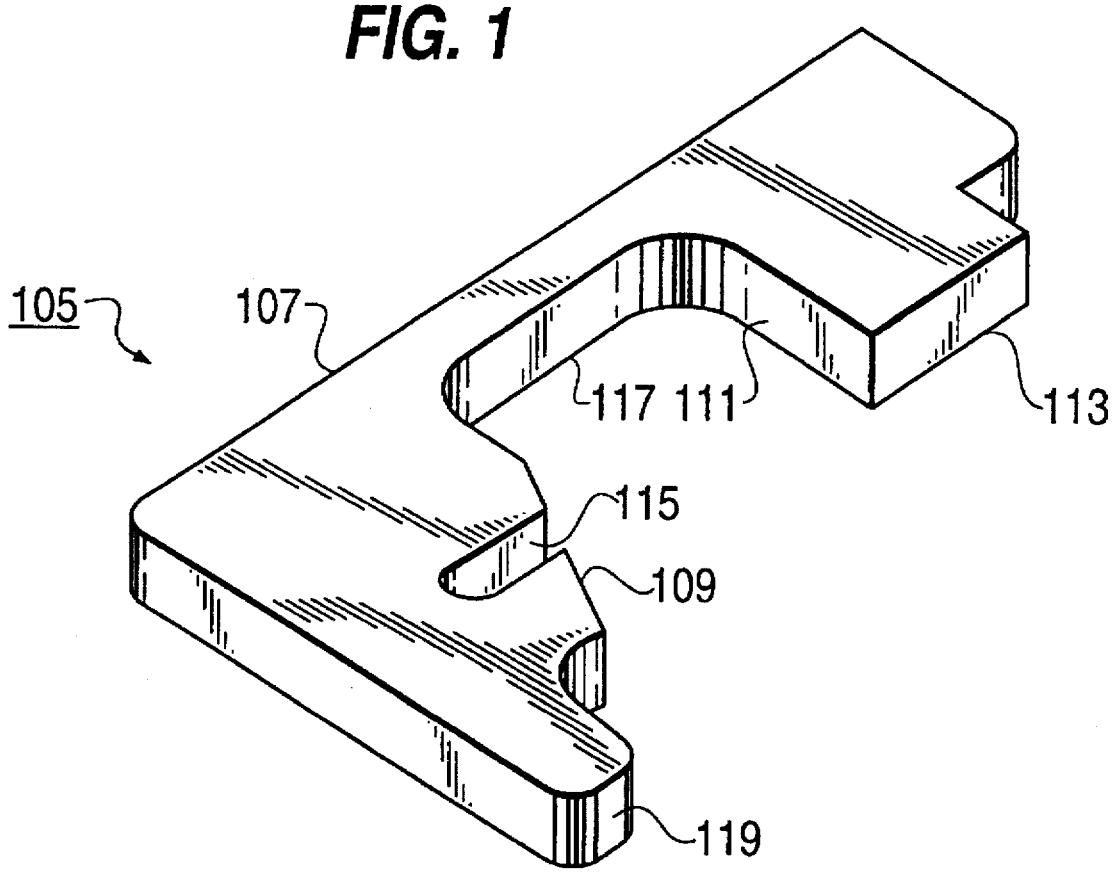
FIG. 1 shows a first embodiment according to the invention.

FIG. 1 shows a first embodiment according to the invention where a door stop can be, made from a thermoplastic material such as polyphenylene sulfide, by, for example, injection molding. The door stop is generally referred to as hem flange door stop 105, which includes body 107, protruding member 109, brace 111 and locator 113. Protruding member 109 is contiguous with body 107 and forms therewith hem flange groove 115. Brace 111 is contiguous with body 107 and forms therewith post slot 117. In use, hem flange door stop 105 is positioned within a door frame of an automobile body by positioning a hem flange of the automobile within hem flange groove 115 such that a post of the automobile is secured within post slot 117 and locator 113 is positioned within a corresponding slot or hole within the automobile body so that stop 119 protrudes into the door frame in order to prevent a corresponding door from moving into a fully closed position. Thus, when hem flange door stop 105 is positioned within a door frame of an automobile, an automobile door can swing into any operational position other than those positions proximate to a fully closed position because of the presence of stop 119 protruding into the door frame. Hem flange groove 115, post slot 117 and locator 113, acting alone or in combination, can thus serve, for example, as means for securing the hem flange door stop 105 to a portion of the main body of an automobile. Also, stop 119 can serve as means for causing a pivoting member of the automobile to be out of contact with the main body of the automobile.

Figure 2:
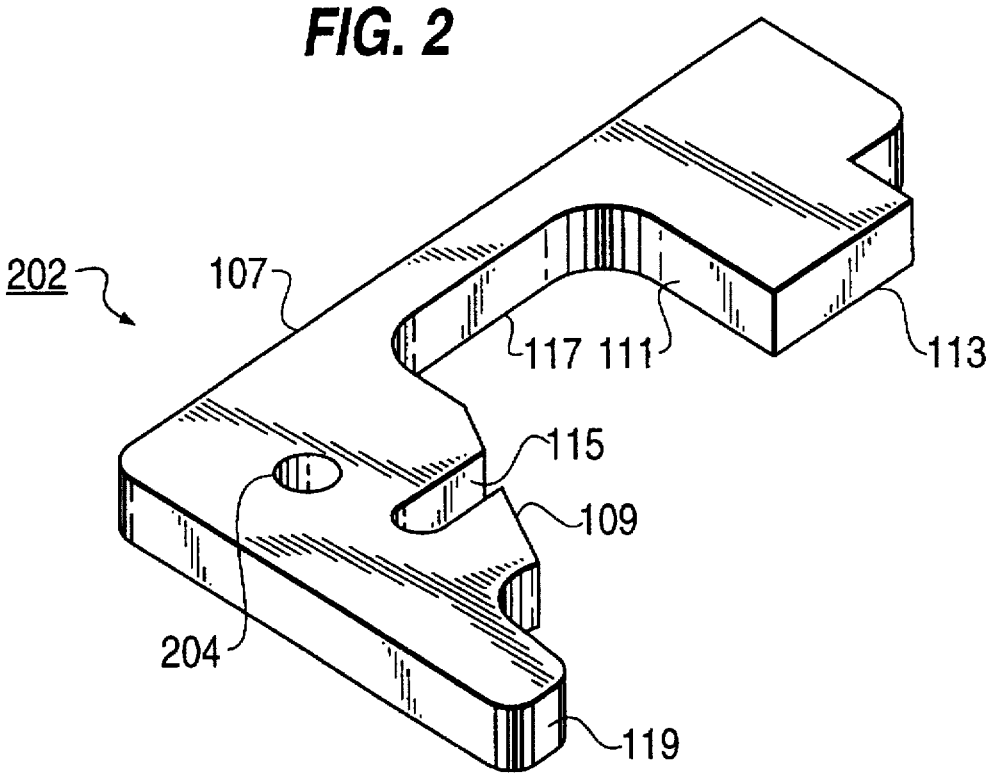
FIG. 2 shows another embodiment according to the invention.

FIG. 2 shows another embodiment according to the invention wherein door stop 202 includes all of the aforementioned elements of the embodiment of FIG. 1, and further includes stabilizer bar attaching hole 204 for engagement with a stabilizer bar to secure the corresponding door in a fixed position.

Figure 3:
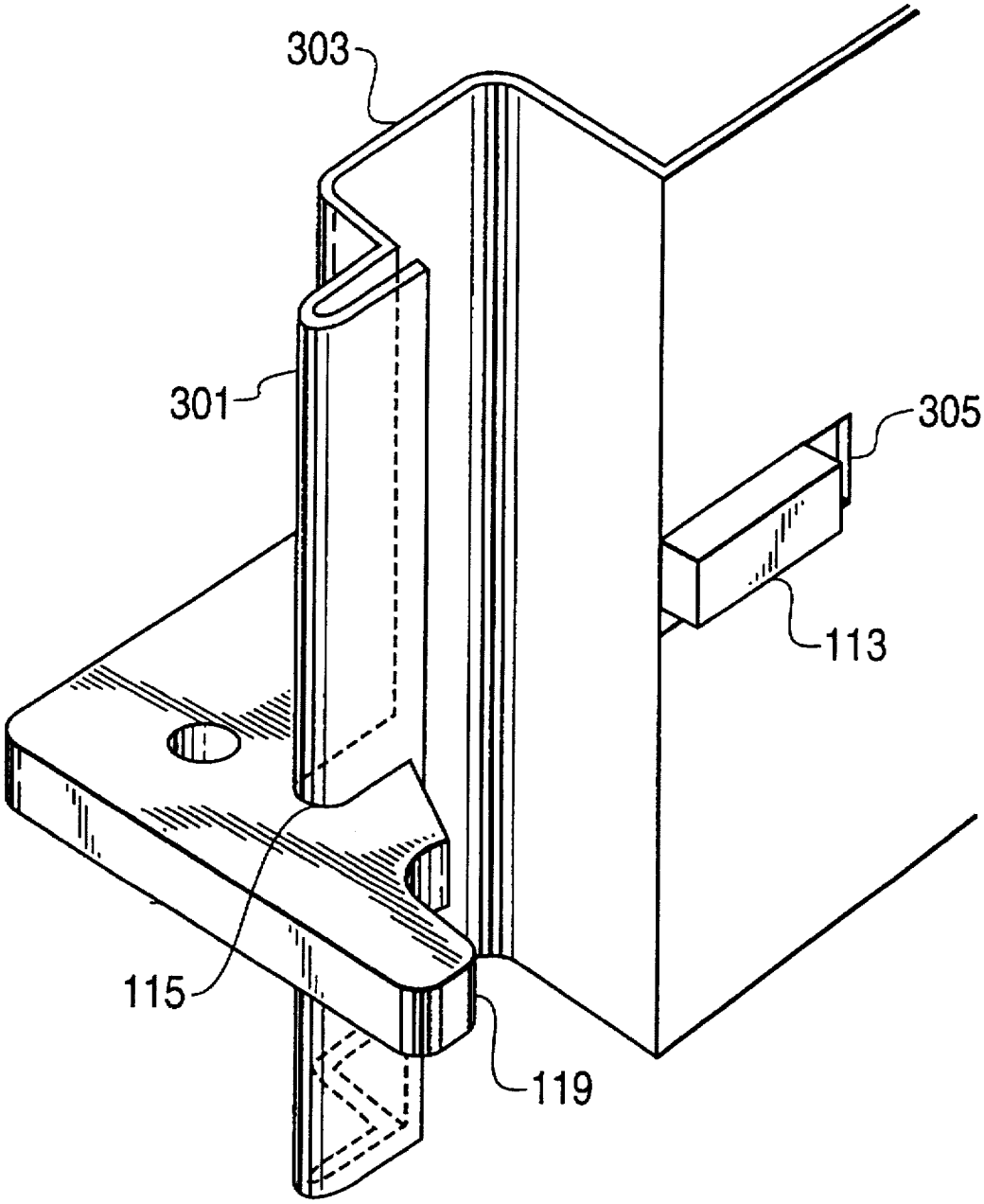
FIG. 3 shows the embodiment of FIG. 2 in engagement with a portion of an automobile body.

FIG. 3 shows door stop 202 positioned such that hem flange groove 115 engages hem flange 301 of an automobile, post slot 117 engages post 303 of the automobile, and locator 113 is positioned in slot 305 of the automobile. As a result of this positioning, stop 119 is positioned within the door frame to prevent the corresponding door from achieving a fully closed position.

Figure 4:
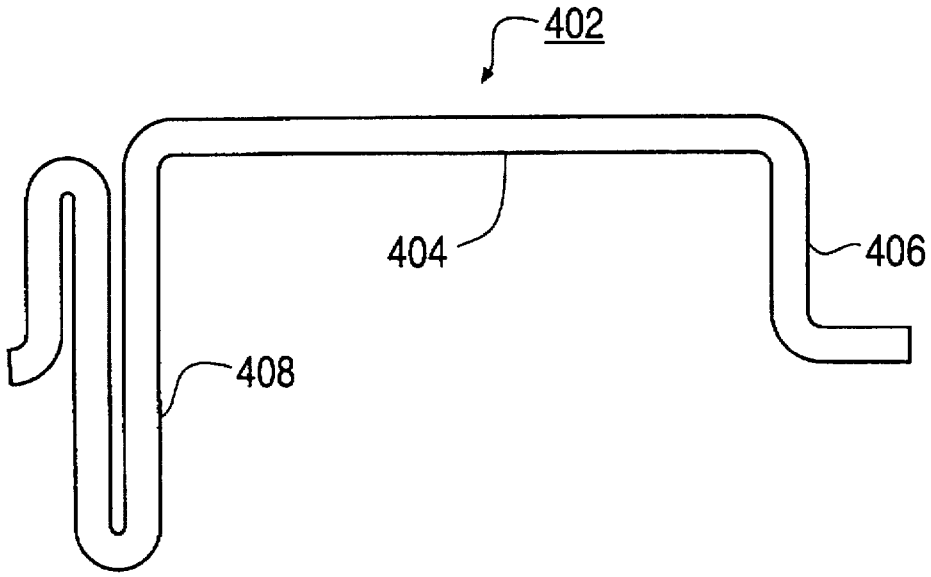
FIG. 4 shows a stabilizer bar for use with the embodiment of FIGS. 2 and 3.

FIG. 4 shows an example of a stabilizer bar for use with a door stop such as that shown in FIGS. 2 and 3. As shown in FIG. 4, stabilizer bar 402 includes a rigid portion 404 between a hole engaging portion 406 and a door hook portion 408. In operation, hole engaging portion 406 is inserted into stabilizer bar attaching hole 204 and door hook portion 408 is inserted into a corresponding slot of the automobile door to control the position of the door relative to the door stop. If the door stop is positioned as shown in FIG. 3 such that it is in a fixed position relative to the door frame, when stabilizer bar 402 is positioned as described above it will control the position of the automobile door relative to the corresponding door frame.

Figure 5:
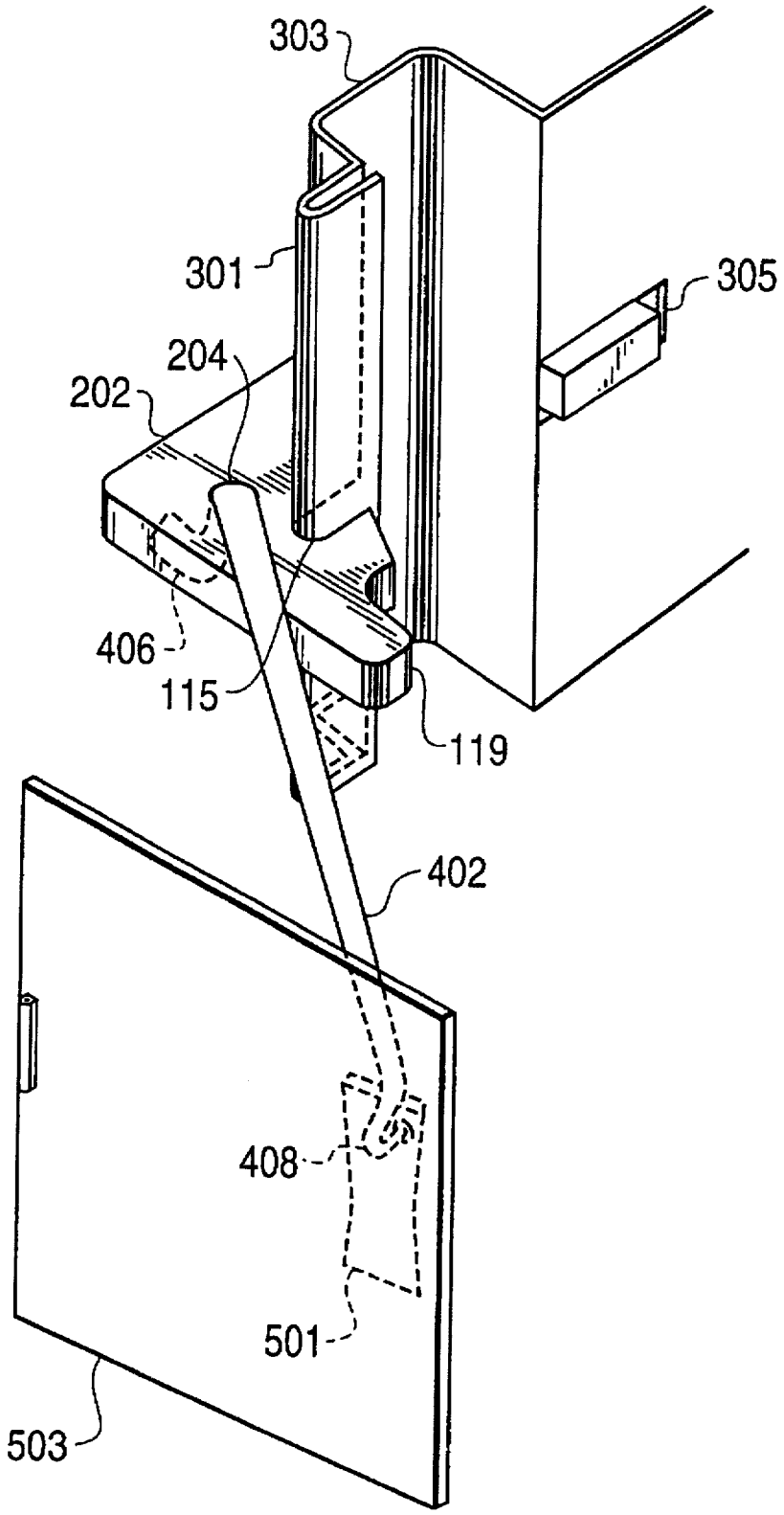
FIG. 5 shows the stabilizer bar of FIG. 4 in operation with an automobile door.

This can be seen, for example, in FIG. 5, which depicts stabilizer bar 402 positioned such that hole engaging portion 406 is inside stabilizer bar attaching hole 204 of door stop 202 while door hook portion 408 is inside a corresponding slot 501 of automobile door 503 to control the position of automobile door 503 relative to door stop 202 and the automobile body to which door stop 202 is attached.

Figure 6:
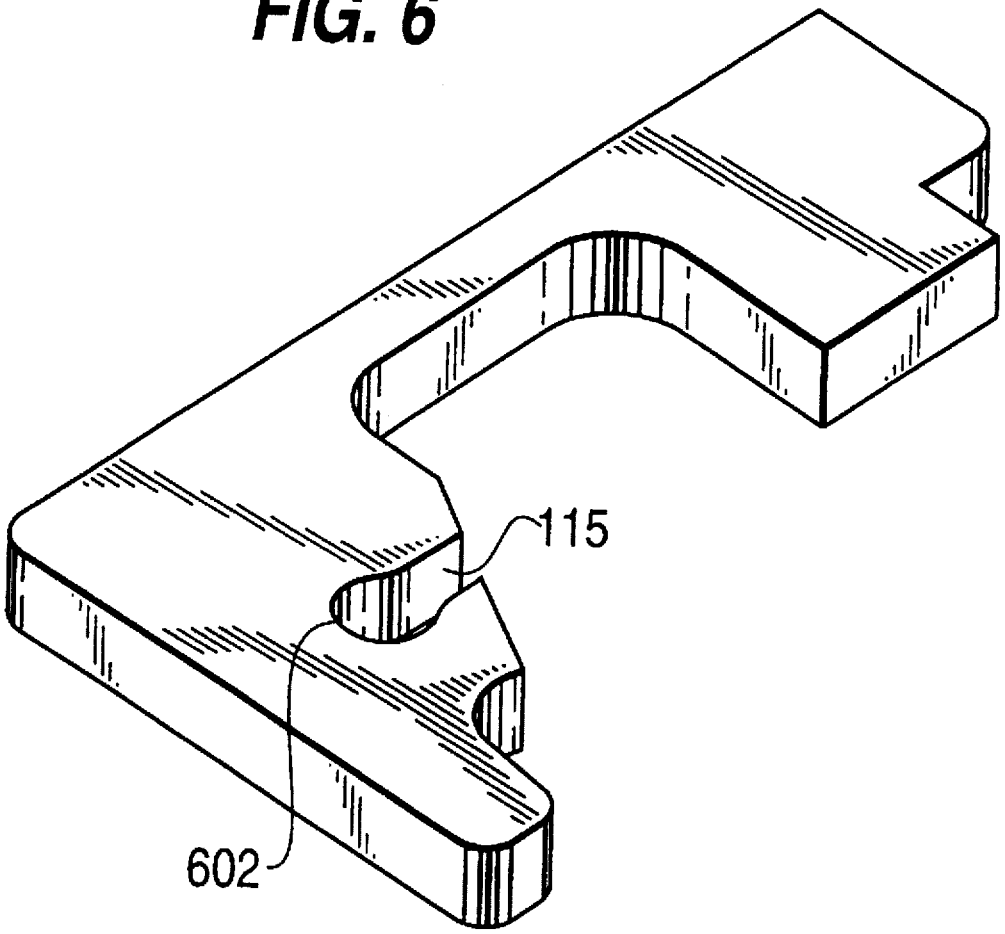
FIG. 6 shows another embodiment according to the invention.

FIG. 6 shows another embodiment according to the invention, which includes all of the elements of door stop 105 shown in FIG. 1, and further includes hem slot undercut 602 at an interior portion of hem flange groove 115. Hem slot undercut 602, which is, for example, a substantially arc-shaped widening of at least one side of the interior of hem flange groove 115 allows for increased maneuverability of a hem flange such as hem flange 301 shown in FIG. 3 while positioning the hem flange into hem flange groove 115. FIG. 6 shows the hem slot undercut 602 incorporated into a door stop such as that of FIG. 1. Of course, hem slot undercut 602 can also be incorporated into a door stop such as door stop 202 of FIG. 2, which includes stabilizer bar attaching hole 204.

Figure 7:
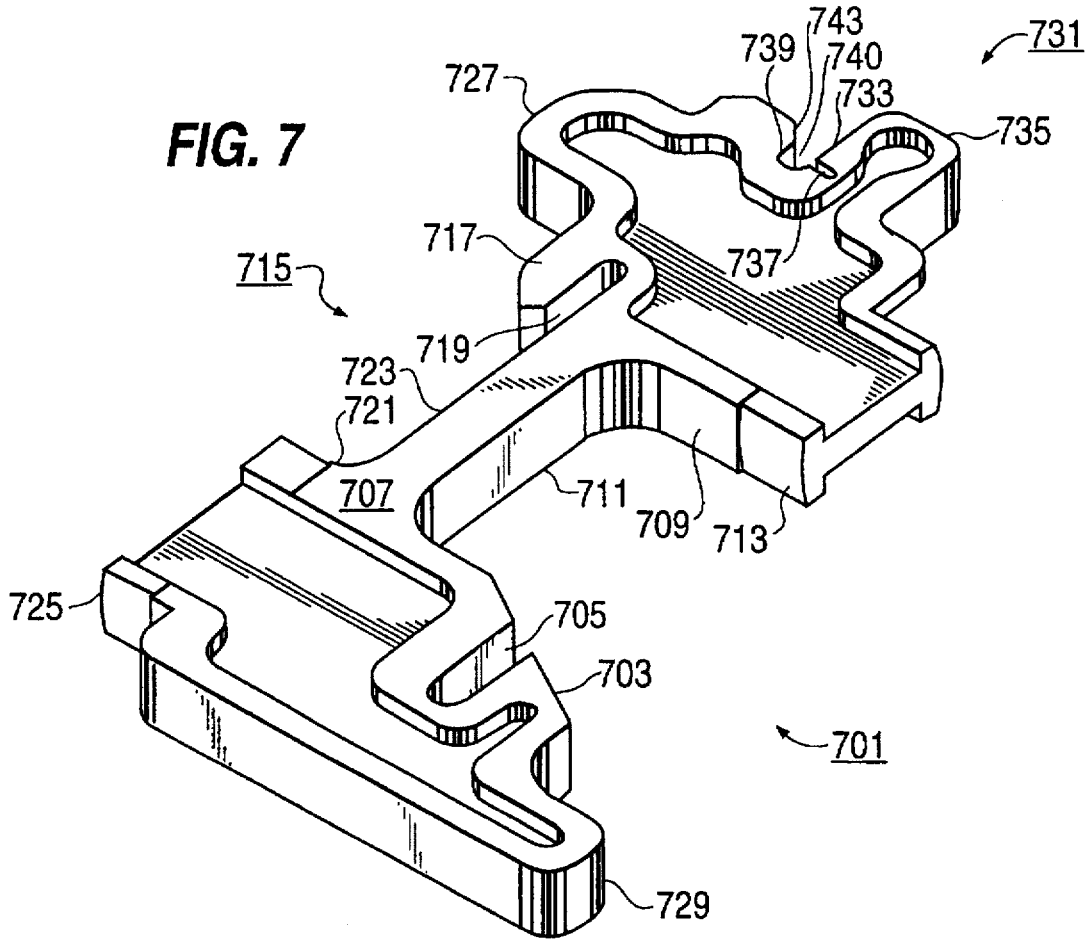
FIG. 7 shows still another embodiment according to the invention.

FIG. 7 shows another embodiment according to the invention, which includes multiple door stops configured into one unitary device. The embodiment of FIG. 7 includes three door stops identified generally as door stops 701, 715 and 731. Door stops 701 contains elements similar to those described above in FIG. 1. For example, it includes protruding member 703, which forms hem flange groove 705 with body 707. It further includes brace, 709 which forms post slot 711 with body 707, and locator 713 for positioning within a corresponding slot of the automobile body. It will be appreciated that the dimensions of, for example, hem flange groove 705, post slot 711 and locator 713 must conform to corresponding features of the automobile body being painted. Thus, since designs vary between automobiles, and also typically vary between given doors of an automobile, door stop 701 is likely to be configured for use with only one style of door for a particular automobile. Alternatively, it is possible that door stop 701 can be configured for use with two doors, for example, the front left door and the front right door of the particular automobile.

Thus, to minimize the number of tools required to paint an automobile, the embodiment of FIG. 7 includes multiple door stops such that when automobiles are painted on an assembly line fewer types of door stops need be supplied. In the example of FIG. 7, three door stops are incorporated into one tool. This is purely by way of illustration and not by limitation. Multiple door stop tools can include any number of door stops. Of course, with increased numbers of door stops being incorporated into a single tool, the complexity of the tool design increases proportionately.

The tool shown in FIG. 7 thus also includes second door stop 715, which includes protruding member 717 forming hem flange groove 719 with body 707, brace 721 forming post slot 723 with body 707, and locator 725 proximate to brace 721. When door stop 715 is positioned within an automobile body, stop 727 extends into a door frame to prevent a door from being positioned in a fully closed position. Alternatively, when door stop 701 is positioned within a door frame of an automobile body, stop 727 is positioned within the door frame to prevent a door from achieving a fully closed position. As shown, door stop 701 is dimensioned for use with a first type of door, for example, the front doors of a particular automobile, while door stop 715 is dimensioned for use with a second type of door of the automobile, for example, the rear doors of the same automobile.

FIG. 7 further shows door stop 731, which, in a particular design shown in FIG. 7, is for use with a third type of door of the automobile, for example, the gas cap door of the particular automobile. Here, protruding member 733 is contiguous with stop 735 and forms hem flange groove 737 with body 707. Further, brace 739 forms post slot 740 with body 707. Instead of a locator, such as locator 713 of hem flange door stop 701 or locator 725 of hem flange door stop 715, hem flange door stop 731 includes chamfer 743 for use in positioning hem flange door stop 731 within the third type of door.

The tool of FIG. 7 can further include stabilizer bar attaching holes similar to stabilizer bar attaching hole 204 shown in FIG. 2. Further, each of the door stops 701, 715 and 731 of the tool of FIG. 7 can include a hem slot undercut such as hem slot undercut 602 shown in FIG. 6.

While specific embodiments of the invention have been described and illustrated, it will be clear that variations in the details of the embodiments specifically illustrated and described may be made without departing from the true spirit and scope of the invention as defined in the appended claims.

What is claimed is:

1. A stop adapted for keeping a pivoting member of an automobile ajar from a frame thereof, comprising:

a thermoplastic body having at least two discrete securing means, one of which is adapted to releasibly secure the body to a portion of the frame; and at least two spaced apart discrete abutting portions integral with the body, one of the abutting portions being adapted to be positioned in a pathway of and intercept the pivoting member, wherein the other of the securing means is adapted to releasibly secure the body to another portion of the automobile or a portion of a different automobile, wherein the other of the abutting portions is adapted to be positioned in a pathway of and intercept another pivoting member of the automobile or a pivoting member of the different automobile.

2. A stop according to claim 1, wherein the two securing means are differently dimensioned to accommodate a differently dimensioned frame or different portions of the frame.

3. A stop according to claim 1, wherein the body has a discrete third securing means, which is differently dimensioned from the other two securing means, adapted to secure the body to another portion of the same or different automobile and has a discrete third abutting portion adapted to be positioned in a pathway of a different pivoting member of the same or different automobile.

4. A stop according to claim 3, wherein the body is substantially elongated and each of the three securing means comprises a first slot adapted to receive and releasibly secure the body to a frame portion, a second slot adapted to receive a different location of the frame portion, and a locator adapted to be inserted in an opening, wherein each of the securing means is unitary with the body.

5. A stop according to claim 4, wherein at least one of the second slots of the three securing means has an enlarged slot end portion.

6. A stop according to claim 4, wherein the elongated body has at least one through-hole adjacent one of the second slots.

7. A stop according to claim 6, further comprising a stabilizer for maintaining the pivoting member at a predetermined distance from the frame, wherein the stabilizer is adapted to connect the body, using the through-hole, to the pivoting member.

8. A stop according to claim 7, wherein one end of the stabilizer is adapted to be received in the through-hole.

9. A stop according to claim 1, wherein the thermoplastic comprises polyphenylene sulfide.

10. A hem flange stop for holding either a first pivoting member ajar relative to an automobile frame having a first post, a first hem flange extending from one side of the first post, and a first locating opening positioned adjacent to the first post, at a side opposite the first hem flange, or a second pivoting member ajar relative to the automobile frame having a second post, a second hem flange extending from one side of the second post, and a second locating opening positioned adjacent to the second post, at a side opposite the second hem flange, the stop comprising:

a substantially elongated body;

first and second brace portions in the elongated body;

first and second hem flange slots in the elongated body;

first and second locators extending from the elongated body; and first and second abutting portions extending from the elongated body, wherein the first brace portion is adapted to engage a portion of the first post, the first hem flange slot is adapted to receive a portion of the first hem flange, the first locator is adapted to be received in the first opening, and the first abutting portion is adapted to abut against a portion of the first pivoting member to keep the first pivoting member from engaging the first hem flange, and wherein the second brace portion is adapted to engage a portion of the second post, the second hem flange slot is adapted to receive a portion of the second hem flange, the second locator is adapted to be received in the second opening, and the second abutting portion is adapted to abut against a portion of the second pivoting member to keep the second pivoting member from engaging the second hem flange.

11. A hem flange stop according to claim 10, wherein the first brace portion comprises a first brace slot and the second brace portion comprises a second brace slot.

12. A hem flange stop according to claim 11, wherein the first and second brace slots generally extend parallel with each other and open in opposite directions away from each other.

13. A hem flange stop according to claim 12, wherein the first and second hem flange slots generally extend parallel with each other and open facing toward their respective first and second locators.

14. A hem flange stop according to claim 13, wherein the first hem flange slot and the first brace slot extend generally perpendicularly to each other.

15. A hem flange stop according to claim 13, wherein the second hem flange slot extends contiguous with the second brace slot in a direction generally parallel with the elongated body.

16. A hem flange stop according to claim 10, wherein the first and second locators extend generally perpendicularly to the elongated body in the opposite directions.

17. A hem flange stop according to claim 16, wherein the first and second hem flange slots extend generally perpendicularly to the first and second locators.

18. A hem flange stop according to claim 10, wherein the stop is a single piece formed of a thermoplastic material.

19. A hem flange stop according to claim 18, wherein the thermoplastic material comprises polyphenylene sulfide.

20. A hem flange stop according to claim 10, wherein the first brace portion, hem flange slot, locator, and abutting portion are dimensioned differently from the second brace portion, hem flange slot, locator, and abutting portion to accommodate differently dimensioned post, hem flange slot, and locator.

21. A hem flange stop for holding a pivoting member ajar relative to an automobile frame having a post, a hem flange extending from one side of the post, and a locating opening positioned adjacent to the post, at a side opposite the hem flange, comprising:

a substantially elongated body;

first and second brace portions in the elongated body, at least one of the first brace portions being adapted to engage a portion of the post;

first and second hem flange slots in the elongated body, at least one of the hem flange slots being adapted to receive a portion of the hem flange;

first and second locators extending from the elongated body, at least one of the locators being adapted to be received in the opening; and first and second abutting portions extending from the elongated body, at least one of the abutting portions being adapted to abut against a portion of the pivoting member to keep the pivoting member from engaging the hem flange, wherein the elongated body has a first through-hole near the first hem flange slot and a second through-hole near the second hem flange slot.

22. A hem flange stop according to claim 21, further comprising a stabilizer for maintaining the pivoting member ajar at a predetermined distance from the hem flange, wherein the stabilizer is adapted to connect the body, using one of the through-holes, to the pivoting member.

23. A hem flange stop according to claim 22, wherein one end of the stabilizer is adapted to be received in one of the through-holes.

24. A hem flange stop for holding either a first pivoting member ajar relative to a first automobile frame having a first post, a first hem flange extending from one side of the first post, and a first locating opening positioned adjacent to the first post, at a side opposite the first hem flange, or a second pivoting member ajar relative to a second automobile frame having a second post, a second hem flange extending from one side of the second post, and a second locating opening positioned adjacent to the second post, at a side opposite the second hem flange, the stop comprising:

a substantially elongated body;

first and second brace portions in the elongated body;

first and second hem flange slots in the elongated body;

first and second locators extending from the elongated body; and first and second abutting portions extending from the elongated body, wherein the first brace portion is adapted to engage a portion of the first post, the first hem flange slot is adapted to receive a portion of the first hem flange, the first locator is adapted to be received in the first opening, and the first abutting portion is adapted to abut against a portion of the first pivoting member to keep the first pivoting member from engaging the first hem flange, and wherein the second brace portion is adapted to engage a portion of the second post, the second hem flange slot is adapted to receive a portion of the second hem flange, the second locator is adapted to be received in the second opening, and the second abutting portion is adapted to abut against a portion of the second pivoting member to keep the second pivoting member from engaging the second hem flange.

* * * * *